US012540761B2

(12) United States Patent
Furberg et al.

(10) Patent No.: US 12,540,761 B2
(45) Date of Patent: Feb. 3, 2026

(54) CONTROL OF COOLING SYSTEM WITH MULTIPLE COOLING LINES

(71) Applicant: ELECTROLUX APPLIANCES AKTIEBOLAG, Stockholm (SE)

(72) Inventors: Richard Furberg, Stockholm (SE); Andreas Stefan Aschan, Stockholm (SE)

(73) Assignee: Electrolux Appliances Aktiebolag, Stockholm (SE)

( * ) Notice: Subject to any disclaimer, the term of this patent is extended or adjusted under 35 U.S.C. 154(b) by 146 days.

(21) Appl. No.: 18/288,278

(22) PCT Filed: Apr. 7, 2022

(86) PCT No.: PCT/EP2022/059190
§ 371 (c)(1),
(2) Date: Oct. 25, 2023

(87) PCT Pub. No.: WO2022/228849
PCT Pub. Date: Nov. 3, 2022

(65) Prior Publication Data

US 2024/0210078 A1 Jun. 27, 2024

(30) Foreign Application Priority Data

Apr. 26, 2021 (EP) ..... 21170363

(51) Int. Cl.
*F25B 41/20* (2021.01)
*F25D 11/02* (2006.01)
*F25B 5/02* (2006.01)

(52) U.S. Cl.
CPC ..... *F25B 41/20* (2021.01); *F25D 11/022* (2013.01); *F25B 5/02* (2013.01);
(Continued)

(58) Field of Classification Search
CPC ..... F25D 11/022; F25B 5/02; F25B 41/22; F25B 2600/2501; F25B 2600/2507;
(Continued)

(56) References Cited

U.S. PATENT DOCUMENTS 5,272,884 A * 12/1993 Cur ..... F25B 5/02 62/181
8,161,763 B2 4/2012 Yun et al.
(Continued)

FOREIGN PATENT DOCUMENTS

EP 1106943 A2 * 6/2001 ..... F25B 5/02
EP 2631568 8/2013
(Continued)

OTHER PUBLICATIONS

International Search Report for PCT/EP2022/059190, dated Jun. 20, 2022, 2 pages.

*Primary Examiner* — Jerry-Daryl Fletcher
*Assistant Examiner* — Daniel C Comings
(74) *Attorney, Agent, or Firm* — Chrisman Gallo Tochtrop LLC

(57) ABSTRACT

A cooling system includes a compressor (31), a condenser (32) and at least a first evaporator (34) and a second evaporator (35) connected in parallel with the first evaporator. A refrigerant is circulated in the cooling system. A controller (40) is provided and configured to control the flow of refrigerant to and/or from at least one of said first evaporator and second evaporator based on the superheat of said at least one of the first evaporator and second evaporator.

14 Claims, 6 Drawing Sheets

(52) U.S. Cl.
CPC ..... *F25B 2600/2513* (2013.01); *F25B 2700/21174* (2013.01); *F25B 2700/21175* (2013.01)

(58) Field of Classification Search
CPC .... F25B 2600/2519; F25B 2700/21174; F25B 2700/21175; F25B 41/42
See application file for complete search history.

(56) References Cited

U.S. PATENT DOCUMENTS

| | | | | |
|---|---|---|---|---|
| 10,539,431 | B2 | 1/2020 | Liu et al. | |
| 2007/0089436 | A1* | 4/2007 | Singh | F25B 49/02 62/225 |
| 2007/0119196 | A1* | 5/2007 | Wellman | F25B 47/022 62/151 |
| 2013/0213066 | A1 | 8/2013 | Litch et al. | |
| 2016/0334142 | A1* | 11/2016 | Senf, Jr. | F25B 49/02 |
| 2017/0241687 | A1 | 8/2017 | Litch et al. | |
| 2021/0381708 | A1* | 12/2021 | Butler | F25B 41/24 |

FOREIGN PATENT DOCUMENTS

| | | | | |
|---|---|---|---|---|
| WO | WO-0194855 | A1 * | 12/2001 | F24F 11/84 |
| WO | 2015105845 | | 7/2015 | |
| WO | WO-2025084099 | A1 * | 4/2025 | G03F 7/20 |

* cited by examiner

- PRIOR ART -

- PRIOR ART -

CONTROL OF COOLING SYSTEM WITH MULTIPLE COOLING LINES

TECHNICAL FIELD

The present disclosure relates to a cooling system and a method for control thereof.

BACKGROUND

Most compressor cooling systems used in today's household refrigerators use a capillary tube to reduce the pressure of the refrigerant flowing from condenser to evaporator. Further, many of these cooling systems do not run continuously, but turn on and off in cycles. There is then a compressor on-phase followed by a compressor off-phase.

Such a conventional refrigeration/freezer system is depicted in FIG. 1. Further, in some refrigeration systems, the use of a valve that is in a closed state during a compressor off period results in that the compressor will have to start against a pressure difference between the condenser and evaporator. In order to reduce the need for an increased start torque the valve can be opened a predetermined period before the start of the compressor. This can equalize the pressure difference and may thereby reduce the required start torque. Also, the pre-opening of the valve can improve the energy efficiency of the cooling system. Such a refrigeration system is described in the U.S. Pat. No. 8,161,763.

In more evolved cooling systems at least two evaporators which operate so independently at different temperature ranges and pressure can be provided. In such a multiple evaporator system the compressor or compressor arrangement drives the cooling fluid in two (or more) separate cooling lines. Such systems are even more demanding in terms of providing an efficient control to minimize power consumption. U.S. Pat. No. 10,539,431 describes one possible solution to the control problems that can arise in such multiple evaporator systems.

There is a constant desire to improve the performance in a refrigerant system and to provide more efficient refrigeration system. Hence, there is a need for an improved refrigerator apparatus and to a cooling system used in a refrigerator for multiple evaporator cooling system.

SUMMARY

It is an object of the present invention to provide an improved refrigerator apparatus having multiple evaporators and an improved cooling system therefor.

This object and/or others are obtained by the cooling system, the refrigerator/freezer and method as set out in the appended claims.

As has been realized by the inventors, a cooling system with improved cooling efficiency and thereby energy savings can be achieved in a cooling system with multiple parallel evaporators. The cooling system can become stable if the control takes into account the superheat of the evaporator(s).

In accordance with the invention a cooling system comprising a compressor, a condenser and at least a first evaporator and a second evaporator connected in parallel with the first evaporator is provided. A refrigerant is circulated in the cooling system. Further a controller is provided and configured to control the flow of refrigerant to and/or from at least one of said first evaporator and second evaporator based on the superheat of said at least one of the first evaporator and second evaporator. Hereby a control algorithm that is stable and at the same time enables fast switching in the refrigerant flow is achieved.

In accordance with one embodiment, the controller is configured to control the flow of refrigerant to and/or from both the first evaporator and the second evaporator based on the superheat of the first evaporator and second evaporator, respectively. Hereby an improved control can be achieved.

In accordance with one embodiment, the controller is configured to control the flow of refrigerant to the first evaporator and the second evaporator based on the superheat of the first evaporator and second evaporator, respectively. Hereby an improved control can be achieved.

In accordance with one embodiment, the controller is configured to control the flow of refrigerant from the first evaporator and the second evaporator based on the superheat of the first evaporator and second evaporator, respectively. Hereby an improved control can be achieved.

In accordance with one embodiment, the cooling system has a valve arrangement upstream said first evaporator and said second evaporator and wherein the controller is configured to control the valve arrangement into a first state where the flow of refrigerant is directed to said first evaporator and to control the valve arrangement into a second state where the flow of refrigerant is directed to said second evaporator. Hereby an efficient implementation of the control of the inflow of refrigerant can be obtained.

In accordance with one embodiment, the controller is configured to control the valve arrangement upstream said first evaporator and said second evaporator into a third state where the flow of refrigerant is stopped to both said first evaporator and to said second evaporator. Hereby additional control options are made available in the control of the cooling system.

In accordance with one embodiment, the controller is configured to control the valve arrangement upstream said first evaporator and said second evaporator into a fourth state where the flow of refrigerant is opened to both said first evaporator and to said second evaporator. Hereby additional control options are made available in the control of the cooling system.

In accordance with one embodiment, the valve arrangement upstream said first evaporator and said second evaporator comprises a three-way valve or two two-way valves. Hereby an efficient implementation of the control of the inflow of refrigerant can be obtained.

In accordance with one embodiment the cooling system has a valve arrangement downstream said first evaporator and said second evaporator and wherein the controller is configured to control the valve arrangement into a fifth state where the flow of refrigerant is let out from said first evaporator and to control the valve arrangement into a sixth state where the flow of refrigerant is let out from said second evaporator. Hereby an efficient implementation of the control of the outflow of refrigerant from the evaporators can be obtained.

In accordance with one embodiment the controller is configured to control the valve arrangement downstream said first evaporator and said second evaporator into a seventh state where the outflow of refrigerant is stopped from both said first evaporator and to said second evaporator. Hereby additional control options are made available in the control of the cooling system.

In accordance with one embodiment, the controller is configured to switch the flow of refrigerant to the first evaporator and the second evaporator in a switching cycle. Hereby an efficient implementation of a control algorithm can be obtained.

In accordance with one embodiment, the switching cycle is shorter than a run cycle for the compressor such that multiple switching cycles are executed during one single compressor cycle. Hereby efficient control can be obtained during running of the compressor.

In accordance with another aspect of the invention a refrigerator comprising the cooling system according to the above is provided. The refrigerator can comprise a refrigerator compartment and a freezer compartment and wherein the first evaporator is arranged to cool the refrigerator compartment and the second evaporator is arranged to cool the freezer compartment. Also, the refrigerator can in accordance with some embodiment comprise a third (or even additional) evaporator and wherein the controller is configured to control the flow of refrigerant to and/or from said third evaporator based on the superheat said third evaporator.

BRIEF DESCRIPTION OF THE DRAWINGS

The present invention will now be described in more detail by way of non-limiting examples and with reference to the accompanying drawings, in which.

DETAILED DESCRIPTION

The invention will now be described more fully hereinafter with reference to the accompanying drawings, in which certain embodiments of the invention are shown. The invention may, however, be embodied in many different forms and should not be construed as limited to the embodiments set forth herein; rather, these embodiments are provided by way of example so that this disclosure will be thorough and complete, and will fully convey the scope of the invention to those skilled in the art. For example, like or similar components of different embodiments can be exchanged between different embodiments. Some components can be omitted from different embodiments. Also, some components typically present in a cooling system such as for example a capillary tube and a suction gas heat exchanger are not shown in the examples described below to more clearly illustrate the invention. Like numbers refer to like elements throughout the description.

Figure 1:
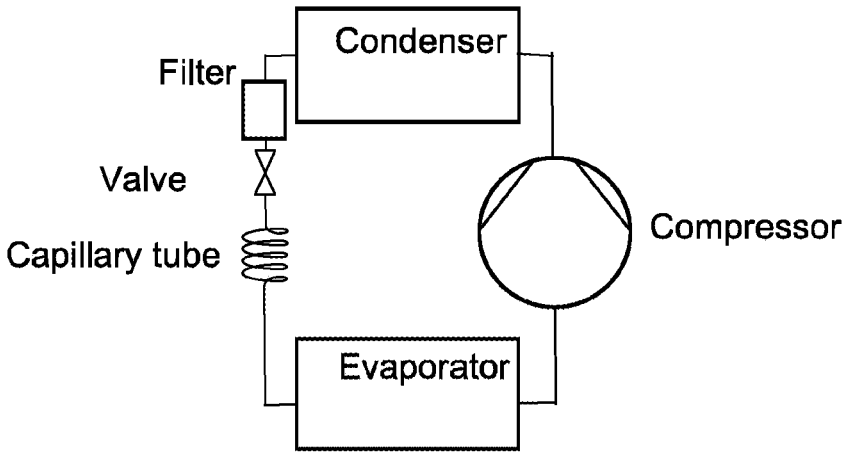
FIG. 1 illustrates a conventional refrigerator cooling system.
Figure 2:
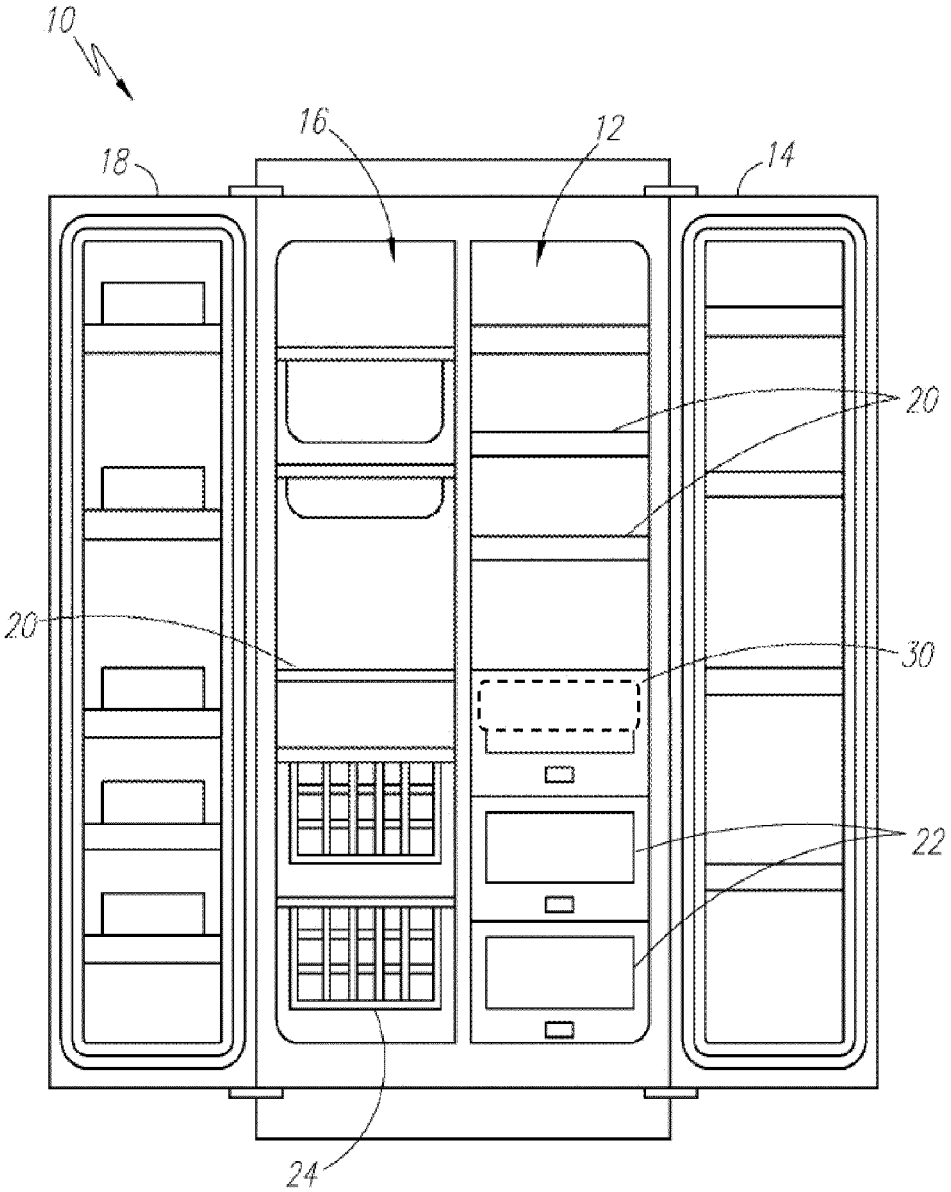
FIG. 2 illustrates a refrigerator.

In FIG. 2, a typical household refrigerator 10 comprising a fresh food compartment 12 and a freezer compartment 16. The exemplary refrigerator 10 in FIG. 2 is of the type known as side by side. However, the cooling system as described herein can be employed in any type of refrigerator such as a French door type, top freezer type, bottom freezer type, or any other type of refrigerator. A door 14, shown in FIG. 2 as open, is mounted to the refrigerator body by hinges and serves to close the front of the fresh food compartment 12 as well as provide access to the interior of the fresh food compartment. A door 18, shown in FIG. 2 as open, also is mounted to the refrigerator body by hinges and serves to close the front of the freezer compartment 16 as well as provide access to the interior of the freezer compartment. The fresh food and freezer compartments can include a variety of shelves 20, closed drawers 22 and basket-like drawers 24 for storing articles of food and the like. Also, other configurations of the household refrigerator 10 can be envisaged depending on the type of refrigerator and to meet different needs. To cool the refrigerator a cooling system 30 is provided. The cooling system 30 can typically be a multiple evaporator cooling system. The evaporators can be arranged to cool different compartments. For example, one evaporator can cool a refrigerator compartment and another evaporator can cool a freezer compartment. Additional evaporators can be provided to cool other compartments. An exemplary cooling system 30 will now be described in more detail with reference to the following Figures.

As has been realized improved cooling efficiency and thereby energy savings can be achieved in a cooling system with multiple evaporators such as the cooling system used for the refrigerator in FIG. 2. By providing a cooling system where both (or more) evaporators can provide cooling power simultaneously, the cooling can be improved because the cooling can be applied over a longer period of time. However, as has been further realized instability problems in the cooling circuit can occur if the circulating refrigerant is not controlled properly. To provide an efficient control that can handle the problem of instability therefore needs to be addressed. To meet this need it has been discovered that the superheat of the evaporator(s) can be utilized as a parameter that makes stable control possible. Thus, the inflow and or outflow from the evaporator(s) can be used to control the superheat to a set temperature and thereby obtain a stable control of the cooling system.

An exemplary cooling system will now be described that uses valves to control the inflow and outflow from the evaporators. However, it is envisaged that other devices can be used to control the flow and or other valve configurations than the configuration depicted in FIG. 3. For example, electronic expansion valve could be used instead of conventional valves in some instances. For example, the valve upstream the evaporators could be implemented using an electronic expansion valve. A controller is configured to control the flow in the evaporators to obtain the desired superheat of the evaporator(s).

Figure 3:
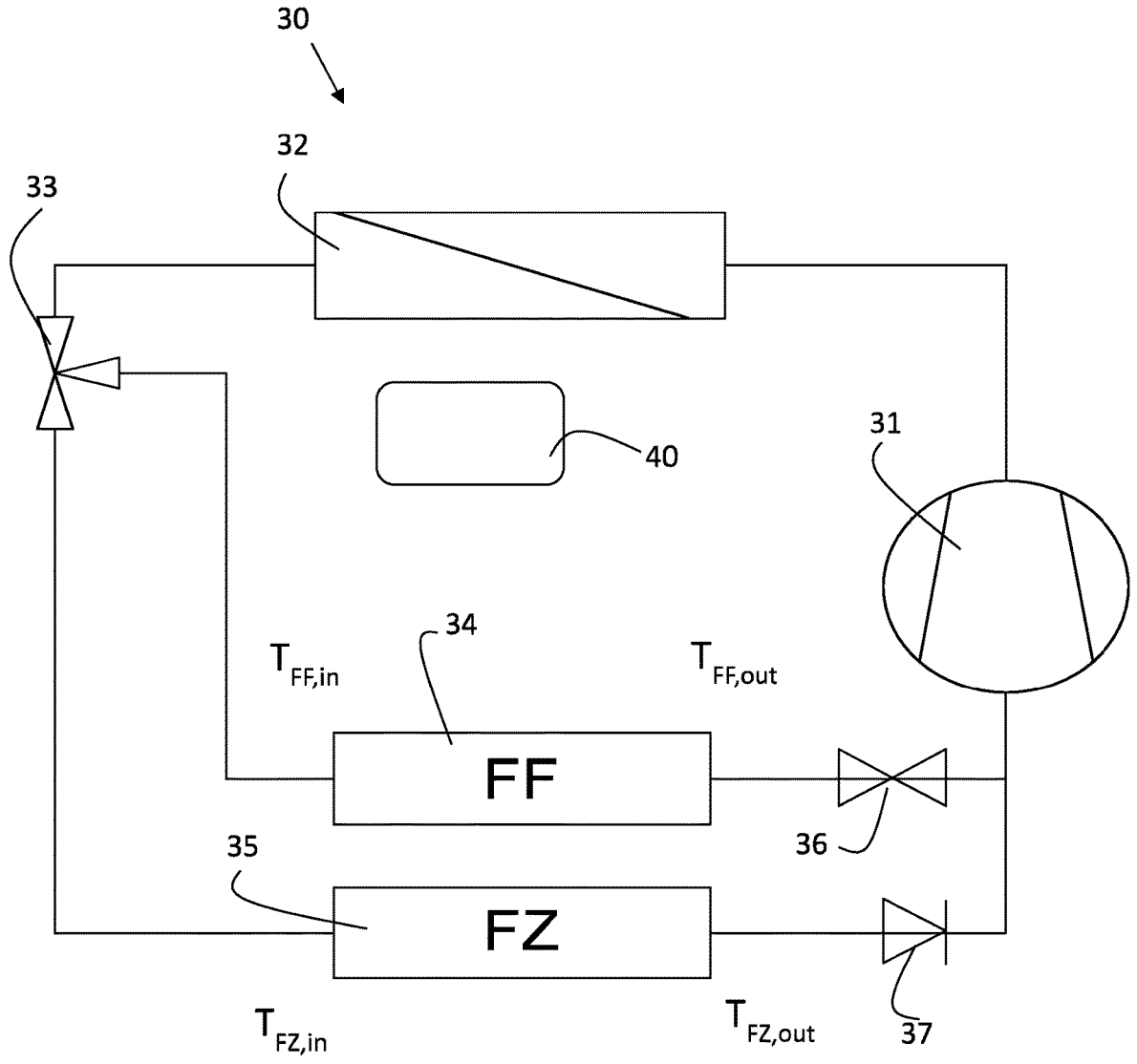
FIG. 3 illustrates a cooling system configuration of a refrigerator apparatus or a similar device.

In FIG. 3, a multi evaporator cooling system 30 for a refrigerator apparatus is illustrated. The cooling system can be however be used as a cooling system for other applications comprising multiple evaporators. In case of a refrigerator, the refrigerator apparatus can be a combined refrigerator/freezer where one evaporator is provided for the freezer and one evaporator is provided for the refrigerator. The cooling system 30 comprises a compressor 31, a condenser 32 and an, at least, two evaporators 34, 35. The cooling system 30 also comprises a valve 33, and a controller 40.

The compressor 31 drives a refrigerant in a cycle whereby the condenser 32 becomes hot and the evaporators 34, 35 become cold. The refrigerant is driven alternating to the first evaporator 34 and to the second evaporator 35 as will now be described in more detail.

In the embodiment of FIG. 3 the first evaporator 34 is assumed to be a refrigerator evaporator FF arranged to cool a refrigerator compartment of the refrigerator 10. Similarly, the second evaporator 35 is assumed to be a freezer evaporator FZ arranged to cool a freezer compartment of the refrigerator 10. In order to reduce energy loss of the cooling system, the refrigerant is switched between the first evaporator 34 and to the second evaporator 35. The switching can be executed using a set of valves, a valve 3-way valve 33 can be provided upstream the evaporators 34, 35. The function of the three-way valve 33 is to direct the refrigerant to one of the evaporators 34, 35 at the time. Thus, when multiple evaporators are arranged in parallel as in the embodiment of FIG. 3, only one of the evaporators is fed with the refrigerant at the time. So, if additional evaporators are arranged in parallel in the multi evaporator cooling system, the circulating refrigerant is driven to only one of the parallel evaporators at the time. The valve 33 is then configured accordingly.

In another embodiment, the refrigerant is allowed to flow to both evaporators 34, 35 at the same time. The valve 33 can then be implemented using a valve arrangement that allows such an additional state that the controller can set the valve to.

Thus, the controller can control the inlet to one or more of the evaporators and thereby control the superheat of the respective evaporators 34, 35.

Further downstream the evaporators a valve arrangement comprising 2 valves 36, 37 is provided. The valves 36, 37 can in accordance with one embodiment be configured such that the valve 36 can be opened and closed and the valve 37 is a check valve preventing the refrigerant to move backwards through the evaporator 35. Hereby a valve arrangement that allows the compressor 31 to drive the refrigerant from both the evaporators can be achieved, where the switching from one evaporator to another can be made fast, in the order of seconds or even milli seconds. The valve arrangement formed by the valves 36, 37 could also be located inside the compressor 31. In the configuration of FIG. 3 a check valve 37 is provided downstream the evaporator with the lowest pressure (the freezer evaporator in this embodiment). Because the pressure from the other evaporator (the refrigerator evaporator in this embodiment) is higher, the check valve is closed when the two-way valve 36 is opened. Thus, the valve arrangement 36, 37 of FIG. 3 can be used to switch the outflow from the evaporators 34, 35 by controlling the state of the two-way valve 36.

Other valve configurations can be used to enable control of the outflow from the multiple evaporators 34, 35. For example a three-way valve can be used instead of the valves 36, 37. The three-way valve can then have inlets from the two evaporators and a common outlet to the inlet of the compressor 31.

Thus, the controller can control the outflow from one or more of the evaporators and thereby control the superheat of the respective evaporators 34, 35.

Because, the switching can be made fast, the efficiency can be improved in that both evaporators can work (cool) simultaneously, due to the inherent inertia of the cooling cycle. However, while the fast switching enables improved energy efficiency, the system risks becoming unstable. Thus, as has been realized, a high amount of refrigerant in one of the evaporators, results in a high flow of refrigerant into that evaporator. To counter act a too high flow of refrigerant, both the valve arrangement upstream the evaporators and the valve arrangement downstream the evaporators can be actively controlled. When too much refrigerant enters an evaporator the cooling system can enter a state where control is difficult because the system will act to increase the flow of refrigerant to the evaporator with much refrigerant.

The control of the valve arrangements 33 and 36, 37 respectively can be controlled in response to the superheat temperature of the evaporators 34, 35. The superheat temperature is the difference between the inlet temperature and the outlet temperature of the respective evaporators 34, 35. In the embodiment of FIG. 3 the superheat temperature in the refrigerator evaporator 34 can be defined as the refrigerator evaporator outlet temperature, TFF,out minus the refrigerator evaporator inlet temperature, TFF,in i.e. (TFF, out-TFF,in). Similarly, the superheat temperature in the freezer evaporator 35 can be defined as the freezer evaporator outlet temperature, TFZ,out, minus the freezer evaporator inlet temperature, TFZ,in, i.e. (TFZ,out-TFZ,in). The superheat can for example be obtained by a pair of temperature sensors arranged along the evaporator(s).

To allow an efficient control, the set superheat that the controller aims to achieve in the when controlling the cooling system can be in the range of 0-10 degrees Kelvin (K). The set superheat that the controller aims to achieve can be pre-set as a system parameter. In accordance with some embodiments the pre-set set value for the superheat can be less than 3 and in particular in the range 0-1 K to achieve an efficient yet stable control of the cooling system.

The valves that can be switched (valves 33 and 36 in the embodiment of FIG. 3) are used together with the compressor to control compartment temperatures and evaporator superheat. The control of the compressor is used to control the total cooling power that the cooling system produces. For example, if the set point for the refrigerator compartment and or freezer compartment cannot be maintained the compressor is controlled to generate more cooling power and vice versa. This can be achieved by running the compressor for longer or shorter periods of time if the compressor is of an on/off type. If the compressor is of a variable speed type, the speed can also be regulated to a higher or lower speed to control the cooling power of the cooling system in addition to control the on/off periods.

To efficiently distribute the cooling via the evaporators, the valves are switched in response to the superheat temperature of the respective evaporators. The switching is performed to control the temperature balance between the two compartments. To control the switching of the valves the superheat over at least one evaporator is used as input parameter. For example, the superheat can be measured as an average over a compressor cycle. In another embodiment, the compressor runs continuously, a floating average over a certain number of short cycles could be used as input parameter to control the switching of the valves. To control the compartment temperatures are measured as average over whole compressor cycles. If the compressor runs continuously, a floating average over a number of short cycles can be used.

The target temperature for the compartments can typically be set to the set point. For the superheat the target temperature can be set dependent on the cooling system and situation at hand.

The valve cycling is controlled to achieve the target in- and outflows of refrigerant in the two evaporators. The superheat in the evaporators can be controlled by increasing/decreasing the time of each position for the two valves 33, 36.

For Example, the 3-Way Valve 33 can be Controlled in Accordance with the Following Principles:

Increase the time of that the refrigerant is directed to an evaporator 34, 35 to reduce the superheat in the respective evaporator and/or increase the cooling power of the compartment cooled by the evaporator, and vice versa. Thus, if for example, the evaporator to a refrigerator compartment needs more cooling power or it is desired to reduce the superheat thereof, the time that the 3-way valve 33 is set to allow refrigerant through the refrigerator evaporator 35 is increased.

If it is desired to increase the superheat in both evaporators 34, 35, the 3-way valve can be set to a closed state whereby refrigerant is stopped to both (all) evaporators of the cooling system.

The 2-way valve 36 can be controlled in accordance with the following principles:

Increase the time of open position to increase superheat in the refrigerator evaporator 34 and/or increase cooling power of refrigerator compartment, and vice versa.

Figure 4:
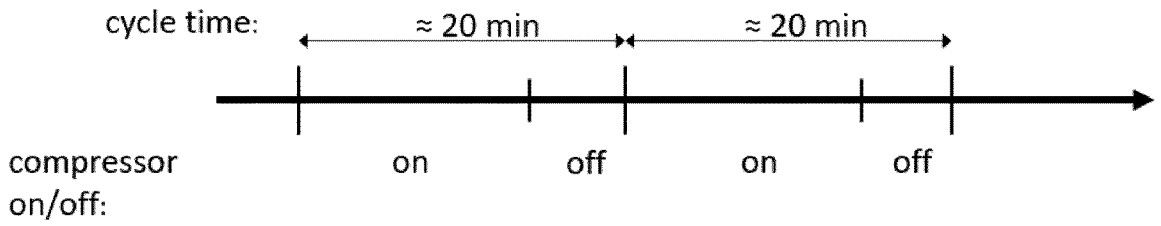
FIG. 4 illustrates a compressor run cycle.

An exemplary control scheme using the cooling system of FIG. 3 will now be described in more detail. In FIG. 4 an exemplary compressor cycle is illustrated. In this example a full compressor run cycle is assumed to be about 20 minutes. During the compressor cycle the compressor is in an on state and also in an off state. The on state the compressor is run in an operational mode to deliver cooling power to the cooling system. In the off state the compressor is turned off or run at a very low speed in case the compressor is of a variable speed type.

Figure 5:
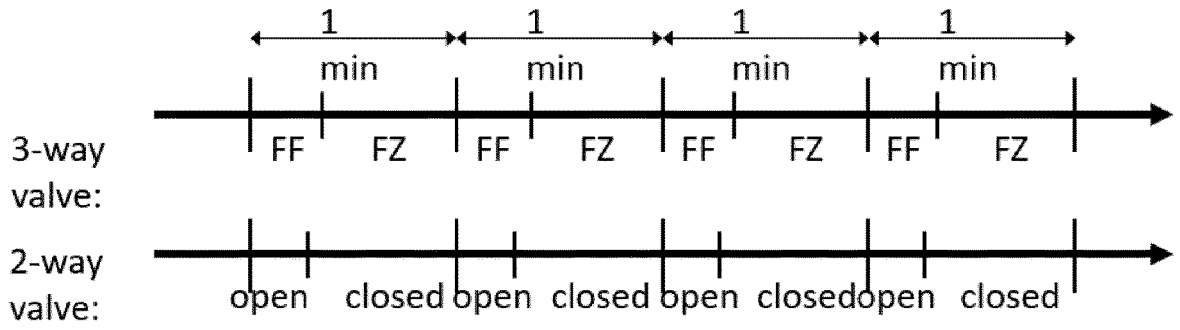
FIG. 5 is illustrates control of flow of refrigerant based on superheat

In FIG. 5 the switching of the valves 33, and 36 is shown during a part of a compressor cycle. First, the 3-way valve 33 is opened to drive the refrigerant to the refrigerator evaporator (FF) 35. Then the 3-way valve 33 is switched to drive the refrigerant to the freezer evaporator (FZ). This pattern can be repeated during the entire on period for the compressor 31. At the same time the 2-way valve 36 is also opened and closed. The 2-way valve 36 can be opened when the 3-way valve 33 is set to drive the refrigerant to the refrigerator evaporator 34. The 2-way valve 36 can be closed when the 3-way valve is switched to drive the refrigerant through the freezer evaporator 35. In accordance with some embodiment the 2-way valve 36 is closed a short time period before the 3-way valve 33 switches from driving the refrigerant to the refrigerator evaporator 34 to drive the refrigerant to the freezer evaporator 35. Thus, the refrigerant inflow to the evaporator(s) can be controlled independent of the outflow of refrigerant from the evaporator(s). Hereby it is possible to control both the inflow to an evaporator and the outflow from the evaporator to achieve an efficient control of the superheat of the evaporator.

The exemplary embodiment of FIGS. 4 and 5 assumes that there are two evaporators connected in parallel, one refrigerator evaporator and one freezer evaporator associated with a refrigerator compartment and a freezer compartment, respectively. However, it is also envisaged that there can be additional evaporators connected in series or in parallel with the two evaporators. Also, there could be more than two compartments.

Figure 6:
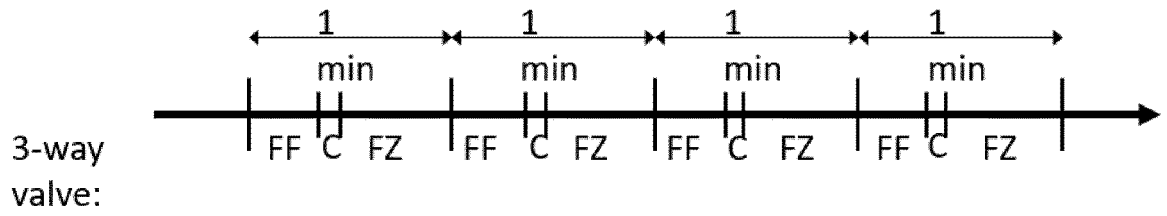
FIGS. 6 and 7 illustrate alternative control methods for control of flow of refrigerant based on superheat, and FIG. 8 illustrate aa controller.
Figure 7:
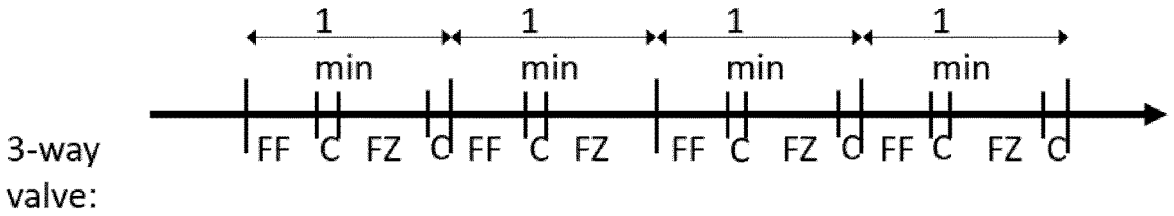

The 3-way valve 33 can also in accordance with some embodiments be set to a closed state during the switching feeding to the different evaporators 34, 35. This is illustrated in FIG. 6 and FIG. 7. In the embodiment of FIG. 6 the 3-way valve 33 is closed a time period after feeding refrigerant to the refrigerator evaporator and before feeding refrigerant to the freezer evaporator. In the embodiment of FIG. 7 the 3-way valve 33 is closed a time period after feeding refrigerant to the refrigerator evaporator and before feeding refrigerant to the freezer evaporator and also a time period after feeding refrigerant to the freezer evaporator and before feeding refrigerant to the refrigerator evaporator.

When controlling the cooling system in accordance with the above, the switching performed to feed the refrigerant to the different evaporators will include multiple switching cycles during a compressor cycle. For example, the short cycling (the switch cycle) can have a fixed cycle time (for example 1 min), and each compressor cycle (for example 20 min) includes a multiple such short cycles.

To obtain a precise temperature control (not within fixed steps), the compressor cycle time can be varied. For example, the compressor off time can be controlled to give the desired compressor run time.

To accurately control the temperatures of the different cooled compartments, the run times of the valve positions for the valves 33 and or the valve 36 can recalculated at suitable time intervals. For example, the valve switching can be recalculated for each new compressor cycle. In such a scenario, the valve switching can be the same for every short cycle within each particular compressor cycle.

In an advantageous embodiment both a valve before (upstream) the evaporators and a valve after (downstream) the evaporators are controlled during such a short cycle. Both valves 33, 36 are then controlled to a target superheat in the two evaporators and the target temperatures in the two compartments. If additional evaporators and or compartments are provided the control can then also take the target superheat and or the target temperature for any such additional evaporators/compartments can also be used.

For example, with reference to the configurations described above in conjunction with FIG. 3, assuming a situation where the temperatures in the two compartments are satisfying, but the superheat in FF evaporator needs to be decreased. There are then two ways of decreasing the FF superheat using the valves:

1) Increasing the FF position time of the 3-way valve

2) Decreasing the open time of the 2-way valve

Changing the superheat can influence the temperature balance between the two compartments. A number of different scenarios are envisaged. For example, Alternative 1 above can decrease the temperature in the refrigerator compartment (and increase the temperature in the freezer compartment). Alternative 2 above can give the opposite effect increases refrigerator temperature and decreases the freezer temperature.

Since both the upstream valve 33 and the downstream valve 36 can be used to control both cooling power (temperature) balance and superheat, it can be beneficial to use both valves 33, 36 to control both temperature and superheat. However, it is also envisaged to use one valve to control superheat, and the other valve to control temperature balance.

Figure 8:
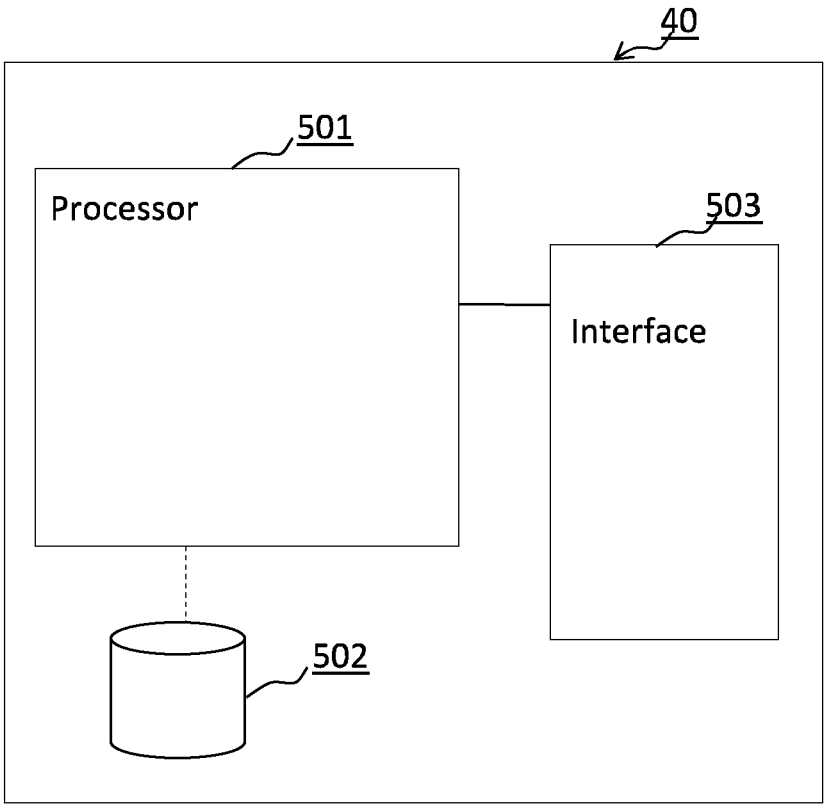

Further, the controller 40 can be implemented using suitable hardware and or software. An exemplary controller is depicted in FIG. 8. The hardware can comprise one or many processors 501 that can be arranged to execute software stored in a readable storage media 502. The processor(s) can be implemented by a single dedicated processor, by a single shared processor, or by a plurality of individual processors, some of which may be shared or distributed. Moreover, a processor or may include, without limitation, digital signal processor (DSP) hardware, ASIC hardware, read only memory (ROM), random access memory (RAM), and/or other storage media. The controller 40, 42 is adapted to send and receive signals from other entities such as the valves 33, 36 and different external sensors or other units using an interface 503. For example, superheat temperatures from the evaporators can be obtained by the controller 40. This can be obtained by receiving signals from different temperature sensors whereby the controller can calculate the respective superheat of the evaporators. The controller 40 can in particular be configured to implement the control procedures as described herein.

By controlling the flow in the evaporators in a cooling system with multiple parallel evaporators based on the superheat of the evaporator(s), an efficient and stable control can be achieved. The flow control is not limited by the exemplary configurations described herein but, any type of flow control elements can be used in any suitable configuration. For example, two two-way valves could be used upstream the evaporators to enable a state where the refrigerant is allowed to flow to both evaporators when two parallel evaporators are present.

The invention claimed is:

1. A cooling system (30) comprising a compressor (31), a condenser (32) and at least a first evaporator (34) and a second evaporator (35) connected in parallel with the first evaporator (34) wherein a refrigerant is circulated, and a controller configured to calculate a superheat of said at least one of the first evaporator and the second evaporator, and calculate a floating average of said superheat over a predetermined number of switching cycles, and control the flow of refrigerant to and/or from at least one of the first evaporator and the second evaporator based on the floating average.

2. The cooling system (30) according to claim 1, wherein the controller is configured to control the flow of refrigerant to and/or from both the first evaporator and the second evaporator based on the superheat of the first evaporator and second evaporator, respectively.

3. The cooling system (30) according to claim 1, wherein the controller is configured to control the flow of refrigerant to the first evaporator and the second evaporator based on the superheat of the first evaporator and second evaporator, respectively.

4. The cooling system (30) according to claim 1, wherein the controller is configured to control the flow of refrigerant from the first evaporator and the second evaporator based on the superheat of the first evaporator and second evaporator, respectively.

5. The cooling system (30) according to claim 1, wherein the cooling system has a valve arrangement upstream said first evaporator and said second evaporator and wherein the controller is configured to control the valve arrangement into a first state where the flow of refrigerant is directed to said first evaporator and to control the valve arrangement into a second state where the flow of refrigerant is directed to said second evaporator.

6. The cooling system (30) according to claim 5, wherein the controller is configured to control the valve arrangement upstream said first evaporator and said second evaporator into a third state where the flow of refrigerant is stopped to both said first evaporator and to said second evaporator.

7. The cooling system (30) according to claim 5, wherein the controller is configured to control the valve arrangement upstream said first evaporator and said second evaporator into a fourth state where the flow of refrigerant is opened to both said first evaporator and to said second evaporator.

8. The cooling system (30) according to claim 5, wherein the valve arrangement upstream said first evaporator and said second evaporator comprises a three-way valve.

9. The cooling system (30) according to claim 1, wherein the cooling system has a valve arrangement downstream said first evaporator and said second evaporator and wherein the controller is configured to control the valve arrangement into a fifth state where the flow of refrigerant is let out from said first evaporator and to control the valve arrangement into a sixth state where the flow of refrigerant is let out from said second evaporator.

10. The cooling system (30) according to claim 9, wherein the controller is configured to control the valve arrangement downstream said first evaporator and said second evaporator into a seventh state where the outflow of refrigerant is stopped from both said first evaporator and to said second evaporator.

11. The cooling system (30) according to claim 1, wherein the controller is configured to switch the flow of refrigerant to the first evaporator and the second evaporator in a switching cycle.

12. The cooling system (30) according to claim 11, wherein the switching cycle is shorter than a compressor cycle such that multiple switching cycles are executed during the compressor cycle.

13. A refrigerator comprising the cooling system according to claim 1.

14. The refrigerator according to claim 13, wherein the refrigerator comprises a refrigerator compartment and a freezer compartment and wherein the first evaporator is arranged to cool the refrigerator compartment and the second evaporator is arranged to cool the freezer compartment.

* * * * *